US005639094A

United States Patent [19]

Manchester

[11] Patent Number: 5,639,094

[45] Date of Patent: Jun. 17, 1997

[54] WORD GAME

[76] Inventor: Vance Manchester, 3039 SE. 174th Ave., Portland, Oreg. 97236

[21] Appl. No.: 412,901

[22] Filed: Mar. 29, 1995

[51] Int. Cl.[6] ..... A63F 9/04

[52] U.S. Cl. ..... 273/432; 273/146

[58] Field of Search ..... 273/432, 146, 273/429, 430, 431

[56] References Cited

U.S. PATENT DOCUMENTS 2,491,883 12/1949 Welch ..... 273/146 X 5,106,103 4/1992 Fidre ..... 273/146 X

*Primary Examiner*—William H. Grieb

*Attorney, Agent, or Firm*—David L. Volk; Brendan B. Dix

[57] ABSTRACT

A first set of cubes has a first set of consonants printed thereon. A second set of cubes has a second set of consonants printed thereon which occur less commonly in english words than the first set of consonants. A third set of cubes has vowels printed thereon. Score cards and a timer are inlcuded.

2 Claims, 2 Drawing Sheets

| Die | #1 | #2 | #3 | #4 | #5 |
|---|---|---|---|---|---|
| Easy Consonants | C,D,F G,H WILD | L,M,N P,R WILD | S,T,W C,D WILD | F,G,H L,M WILD | P,R,S T,W,N |
| Hard Consonants | B,J,K Q,V WILD | X,Y,Z B,J WILD | K,Q,X Y,Z WILD | | |
| Vowels | A,E,I,O,U WILD | A,E,I,O,U WILD | A,E,I,O,U WILD | | |

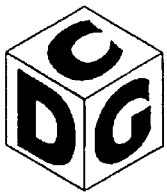
Fig. 1
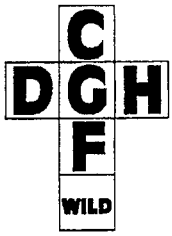
Fig. 2
| Die | #1 | #2 | #3 | #4 | #5 |
|---|---|---|---|---|---|
| Easy Consonants | C,D,F G,H WILD | L,M,N P,R WILD | S,T,W C,D WILD | F,G,H L,M WILD | P,R,S T,W,N |
| Hard Consonants | B,J,K Q,V WILD | X,Y,Z B,J WILD | K,Q,X Y,Z WILD | | |
| Vowels | A,E,I,O,U WILD | A,E,I,O,U WILD | A,E,I,O,U WILD | | |
Fig. 3
| NAME | 1 | 2 | 3 | 4 | 5 | 6 | 7 | 8 | 9 | 10 | TOTAL |
|---|---|---|---|---|---|---|---|---|---|---|---|
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |
| LETTERS | | | | | | | | | | | |
| EASY | | | | | | | | | | | |
| HARD | | | | | | | | | | | |
| VOWEL | | | | | | | | | | | |
Fig. 4

| | 1 | 2 | 3 | 4 | 5 | 6 | 7 | 8 | 9 | 10 |
|---|---|---|---|---|---|---|---|---|---|---|
| LETTERS | | | | | | | | | | |
| EASY | | | | | | | | | | |
| HARD | | | | | | | | | | |
| VOWEL | | | | | | | | | | |
Fig. 5
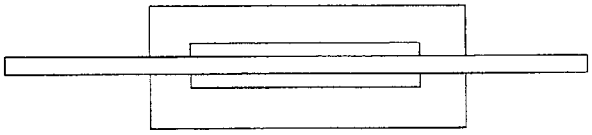
Fig. 7
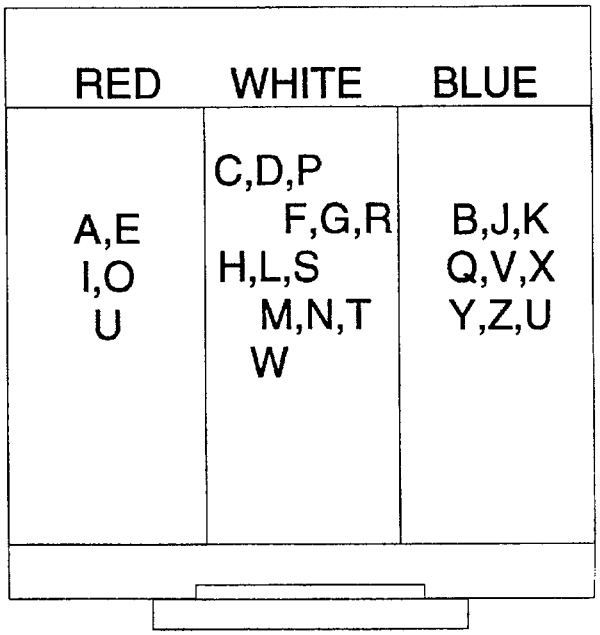
Fig. 6
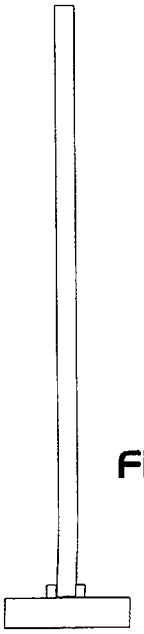
Fig. 8

WORD GAME

BACKGROUND OF THE INVENTION

Heretofore, word games using dice having letters, which dice are thrown by competitive players for the purpose of determining which player can make up the most words from the letters has not been known.

SUMMARY OF THE INVENTION

A word game for creating the most words, by two competitive players, from letters appearing on dice thrown by them.

BRIEF DESCRIPTION OF THE DRAWINGS

FIG. 1 is a perspective view of a die having letters.

FIG. 2 is a view in one plane showing all the faces of the die.

FIG. 3 is a chart showing easy consonants, hard consonants and vowels used on different dice.

FIG. 4 is a scorecard.

FIG. 5 is a player card.

FIG. 6 is a front view, FIG. 7 is a top view, and FIG. 8 a side view of a standing letter card.

DESCRIPTION OF THE PREFERRED EMBODIMENTS

The description of the invention can best be done by setting forth the following rules in relation to FIGS. 1–8

Spellbound Rules: (1) 2 to 6 people fill out the scoring pad, writing down their first .names on the scorecard (shown in FIG. 1) and player card (shown in FIG. 5. (2) The first round of the game begins. (3) Each game consists of 5 to 10 rounds. (4) The player who is chosen to go first picks a category. (5) Then this person rolls the dice, illustrated in FIGS.. 1 and 2. (6) The first dice to be rolled are the white dice of common consonants: C,D,F,G,H, L,M,N,P,R,S,T,W. There are five of these dice and the five letters that come up on the roll are the five that are used in this round of the game. If any of the dice come up the same as another die, then one is rerolled until all of the dice have different letters on them. (7) Then the next group of dice are rolled which are the hard consonants. There are three of these dice. They are: B,J,K, Q,V,X, Y and Z. These dice are rolled until three separate letters are chosen. They are blue in color. (8) In like manner the red dice are rolled and the vowels are selected. There are three of these and each die must have a different letter on it. Vowels are: A,E,I,O,U. (9) If any of the dice come up to reveal just a plain black side, then that is a wild die and each player picks the letter from that particular letter group that he wants that specific die to be. However, the selected letter must not be the same as any of the other letters that have already been chosen for that group. (10) Once all of the letters have been selected for that round, they are written down on the score sheet (shown on FIG. 4) for that round and the letters that were picked for the previous round are crossed out so as to not confuse any of the players as to which letters are being used for the current round of the game. In addition, each player has his own sheet (shown in FIG. 5) on which he writes down all of the selected letters plus his own wild picks. (11) Letters can be repeated as many times as a player wishes within words. (12) Next, a timer lasting two minute in length is turned over and the players have that time to create as many words that they can think of and write them down on a piece of paper. (13) When the timer is finished, all of the players must stop writing words and reveal the words that they were able to think of. (14) Scoring: 5 points to the player who is able to think of the most words. 5 points to the person who is able to come up with the longest word. And 5 points is given to each player for every word that he thinks of that is related to the category. Also in the case of ties, both players receive the points. Also, once each player writes down all of the words that he can think of in the time remaining he must attempt to write a sentence using as many of the words that he has created as possible. Players get 10 points for each of the words used in the sentence that were taken from their list. (15) Next, all of the scores are written down on the score sheet for that round. (16) This process continues until 15 rounds are complete and at that time, the player who has accumulated the most points is the winner.

I claim:

1. A game apparatus comprising eleven cubes having six sides each, each of the cubes having letters printed thereon such that each of the letters is on a different one of the sides, wherein:

a. the letters printed on a first one of the cubes include C, D, F, G, and H;

b. the letters printed on a second one of the cubes include L,M,N,P and R;

c. the letters printed on a third one of the cubes include S,T,W,C and D;

d. the letters printed on a fourth one of the cubes include F,G,H,L and M;

e. the letters printed on a fifth one of the cubes include P,R,S,T,W and N;

f. the letters printed on a sixth one of the cubes include B,J,K,Q and V;

g. the letters printed on a seventh one of the cubes include X,Y,Z,B and J;

h. the letters printed on an eighth one of the cubes include K,Q,X, Y and Z; and i. the letters printed on each of a ninth, tenth and eleventh one of the cubes include A,E,I,O and U.

2. The apparatus of claim 1, further including a means for recording results of rolls of the cubes, a means for recording scores of players, and a timer.

* * * * *